US007156793B2

(12) United States Patent
Spiegel

(10) Patent No.: US 7,156,793 B2
(45) Date of Patent: Jan. 2, 2007

(54) EXERCISE MACHINE AND METHOD FOR EXERCISING THE ANTERIOR DELTOID MUSCLE GROUP

(76) Inventor: Amy Spiegel, 3 Joseph Pl., Levittown, PA (US) 19057

( * ) Notice: Subject to any disclaimer, the term of this patent is extended or adjusted under 35 U.S.C. 154(b) by 307 days.

(21) Appl. No.: 10/417,600

(22) Filed: Apr. 18, 2003

(65) Prior Publication Data

US 2004/0209746 A1 Oct. 21, 2004

(51) Int. Cl.
*A63B 22/14* (2006.01)
*A63B 21/08* (2006.01)
*A63B 21/062* (2006.01)

(52) U.S. Cl. ..... 482/148; 482/97; 482/100

(58) Field of Classification Search ..... 482/97–101, 482/134–138, 148
See application file for complete search history.

(56) References Cited

U.S. PATENT DOCUMENTS 5,171,198 A 12/1992 Jones ..... 482/97
5,409,438 A * 4/1995 Jones et al. ..... 482/100
5,540,640 A 7/1996 Povilaitis ..... 482/108
5,931,767 A 8/1999 Morales ..... 482/102

* cited by examiner

*Primary Examiner*—Gregory Huson
*Assistant Examiner*—Fenn C. Mathew
(74) *Attorney, Agent, or Firm*—LaMorte & Associates

(57) ABSTRACT

An exercise machine and an associated method of exercising that isolates and exercises the anterior deltoid muscles. The exercise machine provides articulating arm elements that support contact surfaces near the biceps of a person who is exercising. To perform the exercise, a person places his/her biceps against the contact surfaces of the articulating arm elements and attempts to elevate their arms forward about their shoulders. The contact surfaces press against the bicep regions of the person's arms and resist the movement. Since the resistance force is applied directly to the upper arm, the exercise does not involve any muscles in the hand, wrist or lower arm. Nearly all of the action needed to perform the exercise is dedicated to the anterior deltoid muscle group. Thus, the anterior deltoid muscle group is isolated for the exercise routine.

7 Claims, 3 Drawing Sheets

EXERCISE MACHINE AND METHOD FOR EXERCISING THE ANTERIOR DELTOID MUSCLE GROUP

BACKGROUND OF THE INVENTION

1. Field of the Invention

The present invention relates to exercise machines that exercise different muscle groups. More particularly, the present invention relates to exercise machines that exercise the deltoid muscle groups.

2. Prior Art Statement

It is well known by bodybuilders, trainers and physical therapists, that the best way to train a particular muscle group is to isolate that particular muscle group when exercising. By isolating a particular muscle group during exercise, the strength of that muscle group can be accurately assessed and tracked. Furthermore, by isolating a particular muscle group during exercise, other surrounding muscle groups are prevented from performing the work of the targeted muscle group. The work contributed by the untargeted muscle groups are therefore minimized. In this manner, by isolating a targeted muscle group that is weak, undersized, or damaged, that targeted muscle group can be made to be made stronger in an efficient manner.

The deltoid muscle group is one of the muscle groups surrounding the shoulders of the arms. The deltoid muscle group includes the posterior deltoid muscles, the lateral deltoid muscles and the anterior deltoid muscles. The posterior deltoid muscles are the muscles used to extends the arms behind the body. The lateral deltoid muscles are the muscles that move the arms outwardly from the sides of the body. The anterior deltoid muscles are the muscles used to raise the arms in front of the body.

The muscles of the deltoids are some of the hardest muscles to isolate when exercising. Since the deltoids control movement of the arms around the shoulder joints, it is difficult to isolate the deltoid muscles and exercise the deltoid muscles without having the muscles of the arm assist in the exercise movement.

The prior art is replete with different types and styles of exercise machines. Many of these machines enable a person to exercise different muscle groups. Some exercise machines and devices isolate the posterior and/or lateral deltoid muscles. For example, U.S. Pat. No. 5,171,198 to Jones, entitled Lateral Raise Exercise Machine and U.S. Pat. No. 5,540,640 to Povilaitis, entitled Deltoid Muscle Exercise Device, both show exercise devices that resist the arms from moving outwardly from the sides of the body. Consequently, both these exercise devices exercise the lateral deltoid muscle groups.

However, it is much harder to create exercise machines that isolate the anterior deltoid muscles. The anterior deltoid muscles are used to raise the arms forward. Most all exercise machines that resist the arms in being raised forward contain handles that are grasped by the hands. Since resistance is being applied to the arms through the hands, it is inevitable that the various muscles contained within the hands, wrists and arms will also act to move the arms against the applied resistance. As a result, the anterior deltoid muscles are exercised with the assistance of other muscles and the anterior deltoid muscles are not themselves well isolated. Prior art exercise machines that exercise the anterior deltoid muscles along with other muscle groups in the arms and chest are exemplified by U.S. Pat. No. 5,931,767 to Morales.

A need therefore exists in the prior art for an exercise machine that isolates the anterior deltoid muscles and exercises the anterior deltoid muscles without having to involve the other major muscle groups in the arms. This need is met by the present invention as described and claimed below.

SUMMARY OF THE INVENTION

The present invention is an exercise machine and an associated method of exercising that isolates and exercises the anterior deltoid muscles. The exercise machine provides articulating arm elements that support contact surfaces near the biceps of a person who is exercising. To perform the exercise, a person places his/her biceps against the contact surfaces of the articulating arm elements and attempts to elevate their arms forward. The contact surfaces press against the bicep regions of the person's arms and resist the movement. Since the resistance force is applied directly to the upper arm, the exercise does not involve any muscles in the hand, wrist or lower arm. Nearly all of the action needed to perform the exercise is dedicated to the anterior deltoid muscle group. Thus, the anterior deltoid muscle group is isolated for the exercise routine.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

Figure 1:
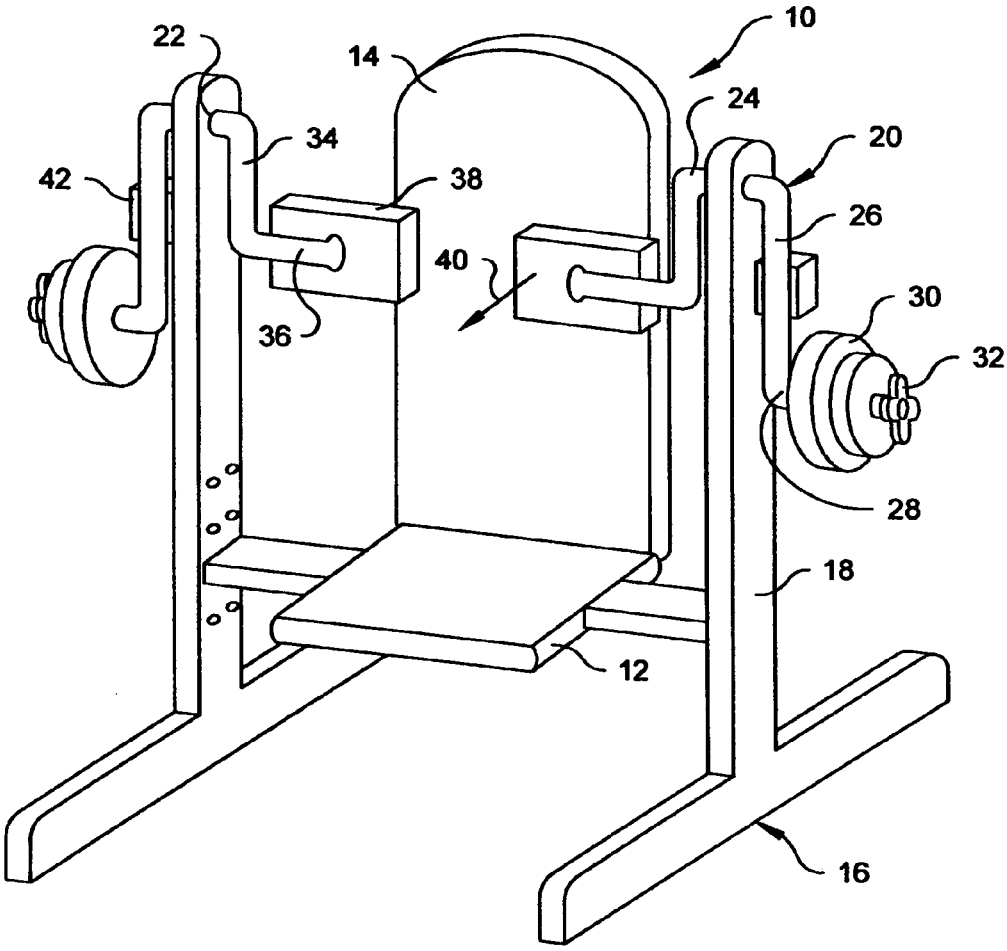
FIG. 1 is a perspective view of an exemplary embodiment of the present invention.

Referring to FIG. 1, an exemplary embodiment of an exercise device 10 is shown that is designed to isolate and exercise the anterior deltoid muscles. The exercise device 10 contains a seat 12 upon which a person can sit. The height of the seat 12 can be adjustable to accommodate people of different heights. An optional backrest 14 can also be provided, wherein the backrest 14 is attached to the seat 12 and adjusts in height with the seat 12.

A framework 16 surrounds the seat 12. The framework 18 includes two vertical columns 18 that extend upwardly on either side of the seat 12. The seat 12 may be selectively attachable to the vertical columns 18 at different heights, so as to be adjustable in height.

Shaft channels 22 are formed near the top end of each of the vertical columns 18. The shaft channels 22 extend horizontally, wherein the shaft channels 22 on both the vertical columns 18 are linearly aligned.

An arm element 20 is supported by each of the vertical shafts. Each arm element 20 has a horizontal shaft section 24 that extends through the shaft channels 22 in the vertical columns 18. The horizontal shaft sections 24 of the arm elements 20 rotate freely within the shaft channels 22. Accordingly, the arm elements 20 are free to rotate while supported by the vertical columns 18.

The horizontal shaft section 24 of each arm element 20 is disposed near the center of that arm element 20. A weight support configuration extends from the horizontal shaft section 24 on each arm element 20, on the outside of each vertical column 18. The weight support configuration includes a first vertical section 26 that extends from the horizontal shaft section 24 at a right angle. The length of the first vertical section 26 can be altered as desired, but is preferably between eight inches and thirty-six inches in length. A weight pin 28 extends from the first vertical section 26 near its bottom end. The weight pin 28 can be threaded and is sized to receive annular weight plates 30. A threaded hub 32 is provided to retain the weight plates 30 on the weight pin 28. Consequently, by varying the number and size of the weight plates 30 placed on the weight pin 28, most any weight under two hundred pounds can be placed onto the weight pin 28. If a longer weight pin 28 is used, more than two hundred pounds of weight plates 30 can be used.

A second vertical section 34 extends from the end of the horizontal shaft section 24 on the side opposite the first vertical section 26. The second vertical element 34 also extends from the horizontal shaft section 24 at a right angle. The length of the second vertical section 34 is equal to or shorter than the length of the first vertical section 26. If the second vertical section 34 is shorter than the first vertical section 26, it is preferably shorter by an even multitude of length. Consequently, if the second vertical section 34 has a first length, the first vertical section 26 is two, three or four times as long as that length.

A horizontal section 36 extends from the bottom of the first vertical section 26. The horizontal section 36 is parallel to the horizontal shaft section 24 of the arm element 20. The horizontal section 36 supports a contact surface in the form of a contact pad 38.

When a force is applied to the contact pad 38 in the direction of arrow 40, the second vertical section 34 turns as a crank arm and rotates the horizontal shaft section 24 that passes through the vertical column 18. The horizontal shaft section 24 rotates the first vertical section 26, thereby raising the weight plates 30 in the same direction as arrow 40. If the second vertical section 34 is the same length as the first vertical section 26, no mechanical advantage is produced and the force needed to move the contact pad 38 in the direction of arrow 40 is equal to the resistance force provided by the weight plates 30 that biases the first vertical section 26 into its normal vertical orientation. However, if the first vertical section 26 is longer than the second vertical section 34, a mechanical advantage is produced. The force needed to move the contact pad 38 in the direction of arrow 40 is equal to the resistance provided by the weight plates 30 times the proportional difference in length between the first vertical section 26 and the second vertical section 34. As such, if the first vertical section 26 is twice as long as the second vertical section 34, and 100 pounds of resistance is provided by the weight plates 30, 200 pounds of force would have to be applied to the contact pad 38 in order to farther move the contact pad 38.

A stop plate 42 extends from each vertical column 18 behind the first vertical section 26 of each arm element 20. The stop plates 42 prevent the first vertical section 26 from rotating backward beyond the vertical position. As such, each stop plate 42 also prevents the contact pads 38 from traveling backward beyond the position shown in FIG. 1.

Figure 2:
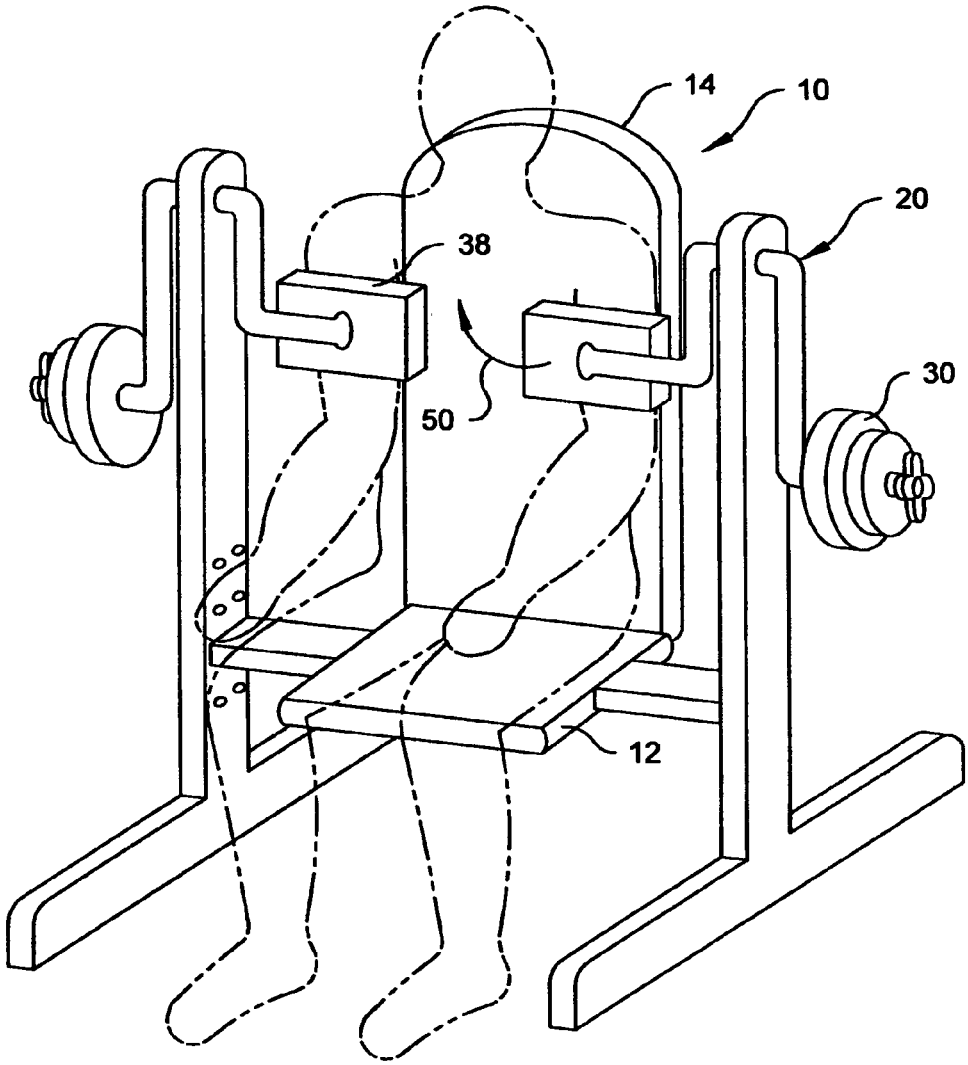
FIG. 2 is a fragmented perspective view of the embodiment of FIG. 1 to show body engagement.

Referring to FIG. 2, it can be seen that when a person sits on the seat 12 of the exercise device 10, the torso of the person is in between the backrest 14 and the contact pads 38. When a person is seated in the seat 12, the shoulders and back of that person extend primarily in a first common plane. When that person's arms are at his/her sides, that person's arms are also in that first common plane. The purpose of the present invention exercise device 10 is to bias the arms of the person sitting in the seat 12 into that first common plane, thereby providing resistance to the elevation of the arms forward and the upward movement in a plane perpendicular to the first common plane.

To utilize the present invention exercise device 10, the seat 12 is adjusted so that the contact pads 38 are aligned in front of the bicep regions of the upper arms. Once a person's bicep regions are in contact with the contact pads 38, that person can elevate his/her arms upwardly in the direction of arrow 50. This direction of elevation is perpendicular to the first common plane of the user's body in which the user's shoulders lie.

As a person elevates his/her arms out of the same plane as their shoulders, the bicep regions of the arms press against the contact pads 38. This displaces the weight plates 30, via the articulating arm elements 20, whereby the weight of the weight plates 30 resists the movement. The amount of resistance provided by the weight plates 30 increases proportionally as the arms are elevated forward from the common plane of the shoulders to a position perpendicular to that plane. When the bicep region of the upper arm is elevated into a horizontal position, the first vertical section 26 of the arm element 20 is also elevated into a horizontal position. At this point, the torque in the arm element 20 is at its maximum.

Since the contact pads 38 press against only the bicep regions of the user's arms, the hands are not used. The muscles in the hands, wrist and lower arms do not help in the moving of the contact pad 38. When elevating the arm forward about the shoulders and pressing against the contact pads 38 with the bicep regions of the arms, the anterior deltoid muscles in the shoulders are nearly completely isolated.

In the embodiment of FIG. 1 and FIG. 2, the resistance force provided by the weight plates 30 varies in proportion to displacement. The further the weight plates 30 are displaced the more torque they provide and the greater the resistance.

Figure 3:
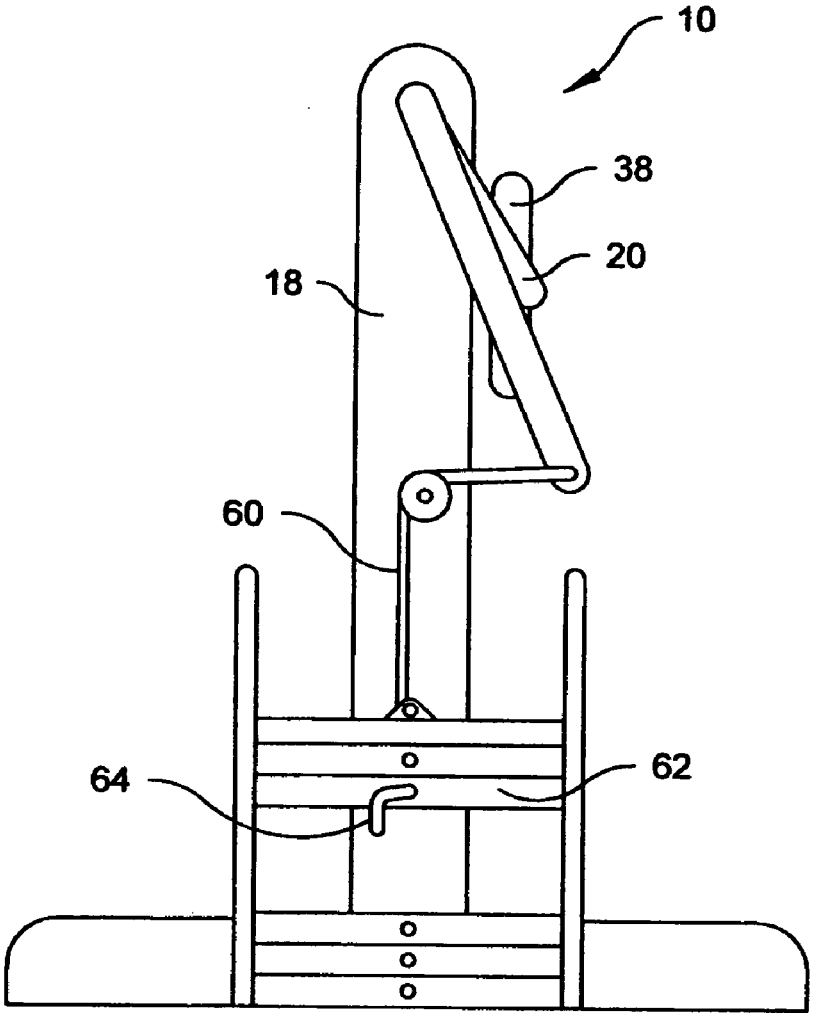
FIG. 3. is a side view of an alternate embodiment of the present invention.

Some trainers, bodybuilders and physical therapists prefer that a resistance force be constant throughout a range of motion. Referring to FIG. 3, an embodiment of the present invention exercise device 60 is shown where the resistance force is constant throughout the range of motion for the exercise. In this embodiment, a stack of weight plates 62 is provided that run along guides. A pin 64 is used to attach any number of the weight plates 62 to a cable 66. The use of such weight plate stacks is commonplace in many different types of exercise equipment.

The exercise device 60 has vertical columns 18, contact pads 38 and arm elements 20 much as has been previously described in reference to the embodiment of FIG. 1. However, in the embodiment of FIG. 3, there is no weight pin directly on the arm element 20. Rather, the arm element 20 attaches to the cable 66 that leads to the weight plates 62. The weight plates 62 apply a constant tension force to the cable 66. Accordingly, the cable 66 applies a constant resistance force to the arm element 20 throughout its range of motion. A constant force is therefore required to move the contact pad 38 forward at any point in the range of travel.

It will be understood that the embodiments of the present invention that are described and illustrated herein are merely exemplary and a person skilled in the art can make many variations to the embodiments shown without departing from the scope of the present invention. For example, the configuration of the arm element can be varied in a wide variety of configurations. Furthermore, the framework that supports the arm elements can also be varied into many configurations, provided the arm elements support a contact surface that can be engaged by the bicep region of a person's arms and the arm elements move in the curved path of the arm, it can be adapted for use in the present invention.

Similarly, provided the framework supports the arm element in proper position in front of the arms, it too can be otherwise varied. All such variations, modifications and alternate embodiments are intended to be included within the scope of the present invention as defined by the appended claims.

What is claimed is:

1. A method of exercising the anterior deltoid muscles of a person having two arms and two shoulders, wherein each of the arms has a bicep region below a shoulder and wherein the two shoulders are aligned in a first plane, said method comprising the steps of:

contacting the bicep region each arm with an articulating contact surface;

providing a predetermined resistance force to each said contact surface that biases said bicep region of each arm into said first plane and resists the forward raising of the arms about the shoulders out of said first plane; and raising the arms forward about the shoulders, in a plane perpendicular to said first plane, while in contact with each said contact surface and opposing said resistance force.

2. The method according to claim 1, wherein each said articulating contact surface includes an contact pad supported by an arm element, wherein said contact pad contacts the bicep region of the arm and the movement of the contact pad by the bicep region of the arm, causes movement in said arm element.

3. The method according to claim 2, wherein said step of providing a predetermined force includes affixing weights to said arm element that bias said arm element into a set position.

4. A method of training the anterior deltoid muscle group, comprising the steps of:

providing an exercise machine having two contact surfaces in a set position, wherein said exercise machine opposes the movement of said contact surfaces from said set positions with a selectively adjustable resistance force;

orienting a person relative to said exercise machine so that the bicep regions of the person's arms are resting at his/her sides, thereby orienting the person's shoulders and arms in common first plane;

engaging the contact surfaces of said exercise machine with the bicep regions of each arm; and rotating the arms about the shoulders forward of the body toward a second plane that is perpendicular to said first plane, while engaging and moving the contact surfaces from said set positions against said resistance force.

5. The method according to claim 4, wherein said step of providing an exercise machine includes providing an exercise machine with a seat and movable arm elements disposed in front of said seat, wherein said movable arm elements support said contact surfaces.

6. The method according to claim 4, wherein said selectively adjustable resistance force is supplied by weight plates directly attached to said moveable arms.

7. The method according to claim 4, wherein said selectively adjustable resistance force is supplied to said movable arms via a flexible cable.

* * * * *